US011154791B2

(12) United States Patent
Tomazetich

(10) Patent No.: US 11,154,791 B2
(45) Date of Patent: Oct. 26, 2021

(54) SPECIAL-EFFECTS FOGGER

(71) Applicant: Mario Gerard Tomazetich, Himberg (AT)

(72) Inventor: Mario Gerard Tomazetich, Himberg (AT)

( * ) Notice: Subject to any disclaimer, the term of this patent is extended or adjusted under 35 U.S.C. 154(b) by 148 days.

(21) Appl. No.: 16/614,879

(22) PCT Filed: Jun. 13, 2018

(86) PCT No.: PCT/AT2018/060122
§ 371 (c)(1),
(2) Date: Nov. 19, 2019

(87) PCT Pub. No.: WO2018/227225
PCT Pub. Date: Dec. 20, 2018

(65) Prior Publication Data

US 2021/0162312 A1 Jun. 3, 2021

(30) Foreign Application Priority Data

Jun. 16, 2017 (AT) ..... A 50501/2017

(51) Int. Cl.
*A63J 5/02* (2006.01)
*B05B 7/00* (2006.01)
(Continued)

(52) U.S. Cl.
CPC ..... *A63J 5/025* (2013.01); *B05B 7/0081* (2013.01); *B05B 7/0483* (2013.01);
(Continued)

(58) Field of Classification Search
CPC ..... A63J 5/025; B05B 7/0081; B05B 7/0483; B05B 7/1686; B05B 7/22; B05B 17/0615
See application file for complete search history.

(56) References Cited

U.S. PATENT DOCUMENTS 2,662,332 A * 12/1953 McIntire ..... A01M 1/2077 43/129
5,649,427 A * 7/1997 Sawada ..... A63J 5/025 62/48.1

(Continued)

FOREIGN PATENT DOCUMENTS

DE 3442905 A 5/1986
DE 202014102205 U 7/2014
WO 2011117721 A 9/2011

*Primary Examiner* — Steven M Cernoch
(74) *Attorney, Agent, or Firm* — Andrew Wilford

(57) ABSTRACT

The invention relates to a device for producing special effect fog, in particular in the field of stage technology, comprising fog generator (1) which is equipped with a heating element, wherein a fog fluid is evaporated by means of the heating element, and at least one ultrasonic vaporizer (5) which is arranged in a housing (2) on the bottom (3) of a main mixing chamber (4), wherein the fog which is generated by the fog generator (1) can be conducted into the main mixing chamber (4), and wherein, furthermore, a baffle wall (7) is provided in the main mixing chamber (4) close to an outlet opening (6). In addition, a pre-mixing chamber (8) is provided, into which an air stream which is generated by a fan (9) and the fog which is generated by the fog generator (1) can be introduced via respective access openings (14, 15). The pre-mixing chamber (8) is connected by means of a transfer opening (10) to the main mixing chamber (4), wherein the transfer opening (10) is arranged in the main mixing chamber (4) so as to lie opposite the baffle wall (7).

11 Claims, 1 Drawing Sheet

(51) Int. Cl.

| | |
|---|---|
| ***B05B 7/04*** | (2006.01) |
| ***B05B 7/16*** | (2006.01) |
| ***B05B 7/22*** | (2006.01) |
| ***B05B 17/06*** | (2006.01) |

(52) U.S. Cl.
CPC ..... *B05B 7/1686* (2013.01); *B05B 7/22* (2013.01); *B05B 17/0615* (2013.01)

(56) References Cited

U.S. PATENT DOCUMENTS

| | | | | |
|---|---|---|---|---|
| 8,382,008 | B1 * | 2/2013 | Ricciardi | B05B 17/0607 239/102.2 |
| 2008/0290189 | A1 * | 11/2008 | Levi | A01M 1/205 239/102.2 |
| 2018/0221785 | A1 * | 8/2018 | Tomazetich | B05B 17/0607 |

* cited by examiner

SPECIAL-EFFECTS FOGGER

CROSS REFERENCE TO RELATED APPLICATIONS

This application is the US-national stage of PCT application PCT/AT2018/060122 filed 13 Jun. 2018 and claiming the priority of Austrian patent application A20501/2017 itself filed 16 Jun. 2017.

FIELD OF THE INVENTION

The invention relates to a special-effects fogger, particularly for theatrical use, comprising a fog generator having a heating element that vaporizes a fog fluid, as well as at least one ultrasonic vaporizer in a housing at the bottom of a main mixing chamber, it being possible for the fog produced by the fog generator to be conducted into the main mixing chamber, and also with a baffle wall being provided in the main mixing chamber near an outlet port.

PRIOR ART

Such a fogger is described for example in AT 517497 [US 2008/0221785]. Here, a fog fluid formed in a fog generator by a heating element is enriched in a mixing chamber with a fine aerosol from an ultrasonic nebulizer in order to obtain an easily controlled special-effect fog for stage use with numerous positive characteristics.

In most cases, conventional effect fogs are based either on fog fluids vaporized by heating elements or on dry ice, which produces a dense near-ground fog by rapid sublimation. Both principles have many disadvantages. Vaporizable fog fluids are sometimes harmful to health or flammable. The effect fogs created therewith rises rapidly in the stage area and spread, making it difficult to control. Condensate often forms around the fog generator, covering surrounding equipment and the stage floor with an oily layer of condensed fog fluid, which is undesirable and can lead to accidents or damage. The vaporized fluids are perceived as disturbing by singers and musicians because they dry out the air in the stage area and are therefore a hindrance to singing and making music.

The same applies to systems that are based on dry ice. Apart from the fact that they are costly to operate because of the dry ice that is required, this fog can also be kept only near the ground and does not rise higher.

Here as well, the air is massively dried out and enriched with CO2, which can lead to massive problems for orchestra pits or requires the use of additional ventilation systems.

It was already conceived of in DE 3442905 or equivalent EP 0158038 to enrich a vaporized fog fluid with an atomized water-air aerosol. However, the cited printed publications are concerned only with the structure of a conventional ultrasonic vaporizer such as that used for humidifiers and merely make reference to the fact that a fog generator that vaporizes a fog fluid is associated therewith, i.e., placed next to it. The fog and the aerosol are thus mixed here downstream from the two machines, even though it has been shown in practice to not lead to a satisfactory result. In this configuration, the two fogs created in this way do not join together but behave substantially like each fog in itself. The nebulized fog from the ultrasonic nebulizer is less stable and settles quickly, releasing a lot of moisture around the machine. The vaporized fog fluid has the disadvantages described above.

It is for this reason that a fogger was created such as that also described in AT 517497. On the one hand, the droplet size of the ultrasonic nebulizer is set here to the fog particle size of the vaporized fog fluid, and on the other hand, the two fog streams are merged and mixed at the place of origin of the ultrasonic aerosol by a forced air jet, so that an adhesion of the water droplets takes place on the fog particles, thus enabling a more stable and depth-adjustable effect fog to be generated. In one embodiment, it is also proposed that the vaporized fog fluid be conducted into the intake area of a forced air flow fan, but this leads to condensate deposits on the fan blades and thus to problems during operation of the machine and to a poorer end result.

OBJECT OF THE INVENTION

It is therefore the object of the present invention to improve the fogger according to AT 517497, such that the generated effect fog has further improved characteristics in terms of stability and can be produced in different user-selectable quantities and at different vertical depths. Condensation in the region of the outlet is to be avoided in the process. At the same time the stage fog should not dry the stage air also but rather be perceived by the artists present, such as singers and musicians, as pleasant or not objectionable. In order for a wide range of applications with different stage sizes and different climatic conditions to be able to be covered, the machine should have a variety of adjustment options while still being inexpensive to manufacture and cost-effective to operate.

This object is achieved according to the invention in that a premixing chamber is also provided that receives an air stream generated by a fan and the fog generated by the fog generator via respective intake ports, and that the premixing chamber is connected by a transfer port to the main mixing chamber, the transfer port being in the main mixing chamber opposite the baffle wall. By providing a premixing chamber, the fog fluid formed by the heating element is dried in the air stream of the fan and homogenized by swirling so that it is conducted into the main mixing chamber with a uniform fog particle size, where it is forced by the pressure of the air stream from the fan to the place of origin of the aerosol above the water surface of the ultrasonic vaporizer. The frequency of the ultrasonic vaporizers is selected such that the droplet size is adapted to the fog particle size and optimal deposition occurs. An ideal droplet size lies in the range from 2 μm to 10 μm. Excess aerosol is deposited as condensate via the baffle wall in the main mixing chamber, and an optimally stable special-effect fog can be discharged via the outlet port. The baffle wall can be vertical, horizontal, or at an oblique angle depending on the structural conditions in the fogger. The special-effect fog produced in this manner has positive effects on the humidity in the stage area, which is particularly beneficial for the artists working there. Furthermore, this special-effect fog can be kept stable at different vertical depths on the stage for extended periods and also does not result in condensate depositing in the area around the fogger.

It is another advantageous feature that the premixing chamber and/or the transfer port are aligned with the main mixing chamber in such a way that the air-fog stream coming from the premixing chamber impinges on the water surface located above the ultrasonic vaporizer at an oblique angle. The adhesion of the water droplets from the aerosol is particularly effective when the homogenized air-fog stream is aimed directly at the water surface above the ultrasonic vaporizers. Due to the stream of air that is forced in this way, this adhesion is achieved immediately upon formation of the individual aerosol droplets.

According to another advantageous feature, the baffle wall is an element that can be inserted into the main mixing chamber having a hole for the passage of the special-effect fog toward an outlet port, the hole being in the vertical direction at an end of the baffle wall remote from the ultrasonic vaporizer and/or in the horizontal direction at an end of the baffle wall remote from the outlet port. In an especially simple embodiment, the baffle wall can be formed by two plates that can be telescoped into one another, with one of the two plates having the hole on one end edge. The baffle wall can thus be very easily inserted into corresponding grooves in the main mixing chamber. It is advantageous if the hole faces both away from the water surface and from the outlet port of the fogger, so that the special-effect fog that is produced passes over as large a surface of the baffle wall as possible before it exits the fogger, whereby excess condensate can be effectively separated.

Another advantageous feature is that a nozzle is provided at the intake port from the fog generator to the premixing chamber, an inner diameter of the outlet port of the nozzle being smaller than an inner diameter of an evaporator hose wound around the heating element and in which the fog fluid can be conveyed to the heating element and, following evaporation, to the intake port. It has been found to be advantageous that a densely enriched fog is produced in the heating element, which is achieved by the restriction formed by the nozzle at the intake port. This measure also leads to further improvement in the adhesion of the aerosol to the fog.

Furthermore, it is an advantageous feature that a plurality of, preferably between 1 and 120, ultrasonic vaporizers are at the bottom of the main mixing chamber, it being possible for the ultrasonic vaporizers to be controlled individually and/or independently of one another in switching groups. By providing a plurality of ultrasonic vaporizers or groups of ultrasonic vaporizers, it is possible on the one hand for a broad spectrum of different quantities of discharged special-effect fog to be created; on the other hand, adjusting the ratio of aerosol generated by the ultrasonic vaporizers to fog produced by the fog generator can also influence the vertical depth of the emerging special-effect fog.

At the same time, it is another advantageous feature that a controller is provided that can adjust the number and output of the active ultrasonic vaporizers, the speed of the fan, and the ejection power of the fog generator, so that different effects can be set on the basis of different mixing conditions between vaporized fog fluid and atomized water as well different total amounts of special-effect fog produced. The more water droplets are adhered to the fog that is generated by the heating element, the heavier the emerging special-effect fog, which thus remains closer to the ground.

If this ratio is shifted to a lower aerosol content, then layers of special-effect fog can also be produced at greater depths. If deeper fog is needed, all parameters can be regulated accordingly. For instance, the output of the fog generator and the speed of the fan can be increased while more individual ultrasonic vaporizers or ultrasonic vaporizer switching groups are switched on at the same time.

It is an additional advantageous feature that the frequency of the ultrasonic vaporizer is also regulated by the controller. In addition to controlling the number of active ultrasonic vaporizers, it can also be advantageous to adjust the frequency of the individual vaporizers in order to produce different droplet sizes in the aerosol and thus to influence the effectiveness of the adhesion to the fog particles. This may also be necessary, for example, if the air stream through the fan is increased and the mixing of aerosol and air-fog stream takes place with greater turbulence. Any incomplete adhesion that may occur can thus be counteracted by increasing the frequency of the ultrasonic vaporizers, for example. The individual ideal setting conditions are to be selected by the stage crew in coordination with the place of operation and the desired effect.

As another preferred feature, the controller has a programmable memory in which presets for the individual controllable parameters can be stored. In the simplest case, all of the above-mentioned parameters of the fogger are set manually by the user using individual controllers. A provision can also be made, however, to already have certain presets stored in a memory of a controller so that the user only has to select a certain depth of the special-effect fog or a discharge quantity, for example, and the controller regulates the individual setting parameters in accordance with the stored presets.

Another advantageous feature is that an air-humidity sensor is coupled to the controller so the parameters regulated by the controller can be corrected for compensation factors stored in the memory on the basis of the data received from the air-humidity sensor, so that a constant special-effect fog can be generated independently of the environment.

This enables the fogger to be further automated, whereby different places of use can also be detected by the fogger and the correspondingly selected presets can be adjusted by compensation factors. In the case of a very dry operating environment, such as an open-air event in a rather dry climate zone, a higher output of the aerosol is expected to be needed than in a small basement meeting room in a temperate climate zone. The most important factor for the operation of the fogger is the humidity in the environment. This has the most pronounced effect on the behavior of the emerging special-effect fog. As will readily be understood by those with average skill in the art, yet more sensors can be involved in determining appropriate compensation factors if required in a particular application.

Another preferred feature is that the fog generator and its heating element are held in a common housing with the ultrasonic vaporizer, the fan, and the two mixing chambers, or that the fog generator is embodied as a separate module and can be coupled by its outlet port with the intake port of the premixing chamber. In its most compact form, the entire fogger can be in a common housing. Depending on the area of application, the fogger can also be used as an upgrading kit for existing conventional fog generators if they are already in use at the site for example. The fog generator already present as a separate module can then be easily connected by its outlet port to the intake port of the premixing chamber.

Finally, it is an advantageous feature that a UV light source is provided in the main mixing chamber that serves the purpose of sterilizing the special-effect fog that is produced. In principle, both the vaporized fog fluid and the aerosol are germ-free due to the high temperature at their respective points of origin. However, it can also be advantageous to sterilize the special-effect fog produced again in the main mixing chamber by a UV light source before it exits the fogger.

BRIEF DESCRIPTION OF THE DRAWINGS

The invention be described below in greater detail with reference to an embodiment and the accompanying drawings in which.

MANNER(S) OF CARRYING OUT THE INVENTION

Figure 1:
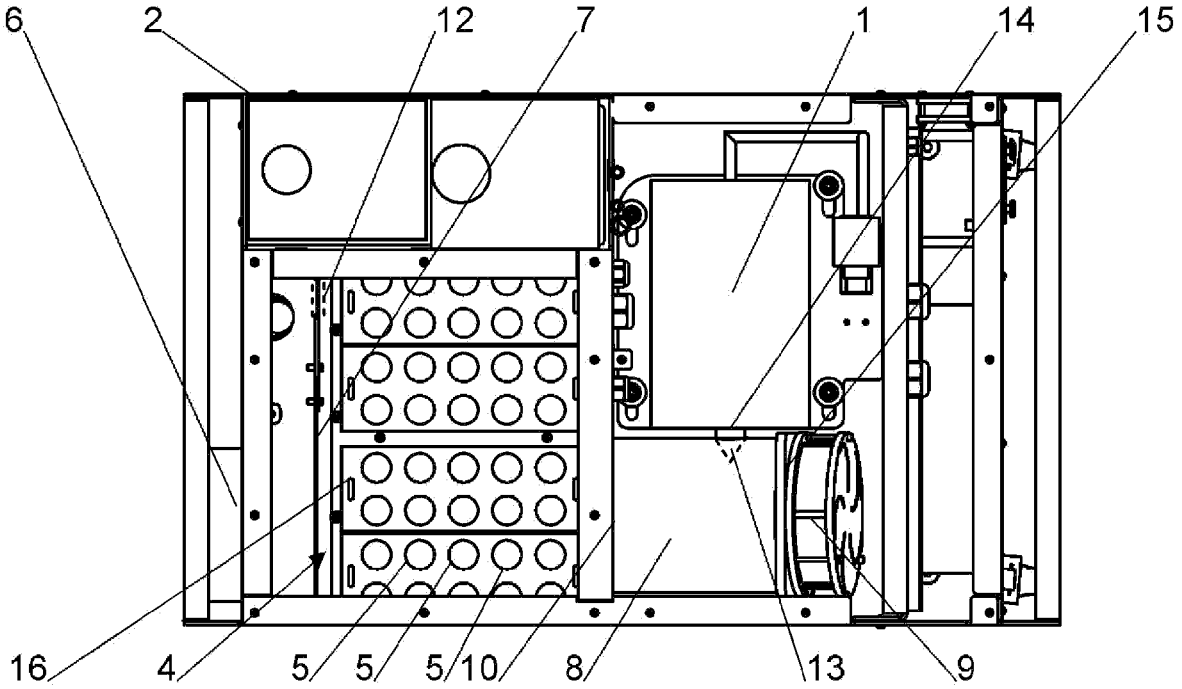
FIG. 1 is a schematic top view of a fogger according to the invention with the housing cover removed.

The embodiment of a fogger according to the invention shown schematically in FIG. 1 comprises a housing 2 holding a fog generator 1 and a heating element. In the fog generator 1, a fog fluid is conducted via a hose to the heating element and there vaporized and subsequently introduced via an intake port 14 in the form of a nozzle 13 into a premixing chamber 8. A fan 9 at a further intake port 15 of the premixing chamber 8 forces an air stream into the premixing chamber 8. The fog generated by the fog generator 1 is thereby swirled in the premixing chamber 8 and thus homogenized and dried.

The resulting fog-air mixture is introduced through a transfer port 10 into a main mixing chamber 4 and passed over liquid-covered ultrasonic vaporizers 5 on a floor 3 of the main mixing chamber 4. In the illustrated example, the ultrasonic vaporizers 5 are arrayed in groups 16 of ten ultrasonic vaporizers 5 each and can be switched on or off individually depending on the application. In the main mixing chamber 4, the fog-air mixture is thus mixed with aerosol droplets generated by the ultrasonic vaporizers 5, and the aerosol droplets adhere to the fog particles. In order for this adhesion to be particularly effective, it is necessary to tune the frequency and output of the ultrasonic vaporizers 5 to the output and temperature of the heating element of the fog generator 1. The desired adhesion takes place only when the aerosol particles and fog particles are of similar size, and the desired weight and thus depth of the emerging special-effect fog can be set by controlling the proportions between fog-air mixture and aerosol.

After mixing in the main mixing chamber 4, the generated special-effect fog is moved against a baffle wall 7. Here, excess condensate is able to settle out before the special-effect fog passes through a hole 12 in the baffle wall 7 toward an outlet port 6. The hole in the baffle wall 7 is oriented such that it is at the upper end in the vertical direction and at the end remote from the port 6 end in the horizontal direction, so that the special-effect fog has to pass along a maximum path and thus over a maximum contact surface with the baffle wall 7 before exiting the fogger.

Figure 2:
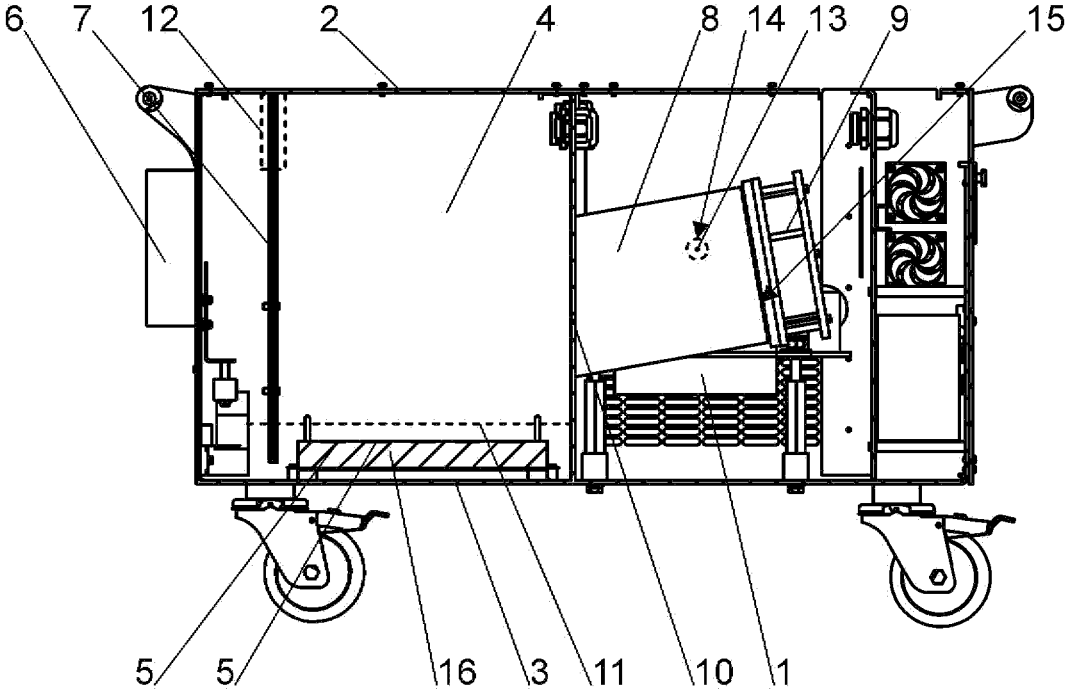
FIG. 2 is a side sectional view of the fogger of FIG. 1.

FIG. 2 shows the fogger of FIG. 1 in a sectional side view. It is readily apparent here that the entire premixing chamber is inclined toward the floor 3 of the main mixing chamber 4, so that the generated air-fog flow hits a water surface 11 precisely above the ultrasonic vaporizers 5. The water surface 11 is always kept constant so that the ultrasonic vaporizer 5 can work optimally. Of course, this means that, depending on the number of active switching groups, the appropriate amount of liquid must be introduced into the main mixing chamber, which is achieved by controlling a feed pump that is coupled in a known manner with corresponding liquid-level sensors. If, due to an error of the feed pump, an excessively high liquid level is established at the ultrasonic vaporizers 5, a corresponding alarm can be triggered. Furthermore, a pumping unit (not shown) can be provided in order to convey excess fluid into a separation tank. In principle, any water can be used as the liquid for the ultrasonic vaporizers, but distilled and/or demineralized water is preferably used, since this makes it possible to implement the desired effects particularly well, and the fogger is less contaminated by deposits.

The invention claimed is:

1. A special-effects fogger for theater use, the fogger comprising:

a fog generator holding a fog fluid and having a heating element for vaporizing the fog fluid;

a housing forming a main mixing chamber holding water and having an outlet hole and a transfer port;

a baffle wall in the housing adjacent the outlet hole;

an ultrasonic vaporizer in the housing at the bottom of the main mixing chamber for vaporizing the water;

a premixing chamber opening through the transfer port into the main mixing chamber opposite the baffle wall and formed with fog and air intake ports of which the fog intake port receives the vaporized fog fluid from the fog generator; and a fan forcing an air stream through the air intake port into the premixing chamber for mixing with the vaporized fog fluid and for passing the mixture of vaporized fog fluid and air through the transfer port into the main mixing chamber and against the baffle wall and out the outlet hole.

2. The fogger according to claim 1, wherein the premixing chamber and the transfer port are aligned with the main mixing chamber in such a way that the mixture of vaporized fog fluid and air coming from the premixing chamber impinges at an oblique angle on a surface of the water above the ultrasonic vaporizer.

3. The fogger according to claim 1, wherein the baffle wall is an element that can be inserted into the main mixing chamber and has a hole for passage of the special-effect fog toward the outlet hole, the hole being in the vertical direction at an end of the baffle wall remote from the ultrasonic vaporizer and/or in the horizontal direction at an end of the baffle wall remote from the outlet hole.

4. The fogger according to claim 1, further comprising:

a nozzle at the fog intake port and directed into the premixing chamber, an inner diameter of the nozzle being smaller than an inner diameter of an evaporator hose wound around the heating element such that the fog fluid can be conveyed to the heating element and, following evaporation, to the foci intake port.

5. The fogger according to claim 1, wherein there is a plurality of ultrasonic vaporizers at the bottom of the main mixing chamber, the ultrasonic vaporizers being controllable individually or independently of one another in groups.

6. The fogger according to claim 5, further comprising:

a controller that can adjust a number and output rate of the ultrasonic vaporizers, a speed of the fan, and an ejection power of the fog generator, whereby different effects can be set on the basis of different mixing conditions between vaporized fog fluid and atomized water as well as different total amounts of special-effect fog produced.

7. The fogger according to claim 6, wherein a frequency of each of the ultrasonic vaporizers can be also regulated by the controller.

8. The fogger according to claim 6, wherein the controller has a programmable memory in which presets for individual controllable parameters can be stored.

9. The fogger according to claim 8, further comprising:

an air-humidity sensor is provided that is coupled to the controller such that the controllable parameters regulated by the controller can be corrected for compensation factors stored in the programmable memory on the basis of the data received from the air-humidity sensor, so that a constant special-effect fog can be generated independently of the environment.

10. The fogger according to claim 1, wherein the fog generator and the heating element are in the housing with the ultrasonic vaporizer, the fan, and the main and premixing chambers, or that the fog generator is a separate module and can be coupled by its outlet port with the fog intake port of the premixing chamber.

11. The fogger according to claim 1, further comprising:

a UV light source in the main mixing chamber that sterilizes the special-effect fog produced.

* * * * *